US010259624B2

(12) United States Patent
Sakimura et al.

(10) Patent No.: US 10,259,624 B2
(45) Date of Patent: Apr. 16, 2019

(54) CAP

(71) Applicants: TOKYO LIGHT INDUSTRY CO., LTD., Tokyo (JP); KYORAKU CO., LTD., Kyoto (JP)

(72) Inventors: Takaaki Sakimura, Tokyo (JP); Masashi Sasaki, Tokyo (JP); Masashi Mizuochi, Tokyo (JP); Hajime Sasaki, Tokyo (JP); Satoshi Ichikawa, Tokyo (JP)

(73) Assignees: TOKYO LIGHT INDUSTRY CO., LTD., Tokyo (JP); KYORAKU CO., LTD., Kyoto (JP)

( * ) Notice: Subject to any disclaimer, the term of this patent is extended or adjusted under 35 U.S.C. 154(b) by 0 days.

(21) Appl. No.: 15/562,676

(22) PCT Filed: Mar. 25, 2016

(86) PCT No.: PCT/JP2016/059658
§ 371 (c)(1),
(2) Date: Nov. 21, 2017

(87) PCT Pub. No.: WO2016/158766
PCT Pub. Date: Oct. 6, 2016

(65) Prior Publication Data

US 2018/0086516 A1 Mar. 29, 2018

(30) Foreign Application Priority Data

Mar. 30, 2015 (JP) ..... 2015-069379

(51) Int. Cl.
*B65D 47/20* (2006.01)
*B65D 47/40* (2006.01)
*B65D 47/08* (2006.01)

(52) U.S. Cl.
CPC ..... *B65D 47/2075* (2013.01); *B65D 47/0838* (2013.01); *B65D 47/20* (2013.01); *B65D 47/40* (2013.01)

(58) Field of Classification Search
CPC ..... B65D 47/2075; B65D 47/40; B65D 47/0838; B65D 47/2018; B65D 47/2025;
(Continued)

(56) References Cited

U.S. PATENT DOCUMENTS 3,165,242 A * 1/1965 Jackson ..... B65D 35/46 222/495
3,245,429 A * 4/1966 Bacino ..... F16K 1/46 137/543.21

(Continued)

FOREIGN PATENT DOCUMENTS

CH 418865 A 8/1966
CN 2661601 12/2004

(Continued)

OTHER PUBLICATIONS

WO2013065599MT, Furusawa, May 2013.*

(Continued)

*Primary Examiner* — Randall Gruby
(74) *Attorney, Agent, or Firm* — Rankin, Hill & Clark LLP

(57) ABSTRACT

An annular protruding portion (17) is provided around an inner plug (13) at a radial interval on an annular horizontal wall portion (20) of a cap body 4. Between an annular flange portion (43*a*) of the inner plug (13) and the annular protruding portion (17), an annular accumulating groove portion (33) is provided. Particularly in the case of a liquid content, the liquid content may be scattered from within a cylindrical guide portion (42) when a lid member (5) is placed after use. The liquid content, however, is blocked by (Continued)

the annular protruding portion (17) and prevented from flowing further outward, while interfering with a top surface portion (51) and a cylindrical scattering suppression portion (55) of the lid member (5). Thus, downward flow of the liquid content along the outer wall surface of the annular horizontal wall portion (20) of a main cap member (11) can be suppressed.

2 Claims, 5 Drawing Sheets

(58) Field of Classification Search
CPC ..... B65D 47/205; B65D 47/2056; B65D 47/2062
See application file for complete search history.

(56) References Cited

U.S. PATENT DOCUMENTS 4,350,179 A * 9/1982 Bunn ..... F04B 39/1053 137/246.12
4,561,570 A * 12/1985 Zulauf ..... B65D 47/242 222/153.14
4,785,978 A * 11/1988 Kano ..... B05B 11/047 215/309
5,207,250 A * 5/1993 Tsao ..... B65D 1/0292 141/18
5,275,312 A * 1/1994 Labruzzo ..... B05B 11/0064 137/540
6,089,272 A * 7/2000 Brand ..... A61M 39/24 137/852
6,708,850 B2 * 3/2004 Uetake ..... A61F 9/0008 222/105
6,974,053 B2 * 12/2005 Lautre ..... B65D 47/2081 222/212
7,059,501 B2 * 6/2006 Masuda ..... B65D 35/14 222/212
7,104,426 B2 * 9/2006 Suzuki ..... B65D 47/2031 222/105
7,500,585 B2 * 3/2009 Masuda ..... B65D 47/2075 137/614.2
7,967,983 B2 * 6/2011 Grevin ..... B65D 47/18 210/321.75
8,141,730 B2 * 3/2012 Smith ..... B65D 47/06 206/0.5
8,302,823 B2 * 11/2012 Lim ..... B65D 47/2075 222/212
8,490,839 B2 * 7/2013 Mihashi ..... A61F 9/0008 222/189.06
8,740,023 B2 * 6/2014 Geiger ..... B65D 47/2025 222/213
8,783,521 B2 * 7/2014 Ishikawa ..... A61F 9/0008 137/859
8,794,490 B2 * 8/2014 Painchaud ..... B65D 47/18 222/493
8,919,608 B2 * 12/2014 Smith ..... B65D 1/32 137/512.4
9,085,409 B2 * 7/2015 Brall ..... B65D 35/46
9,315,313 B2 * 4/2016 Kuwagaki ..... B65D 83/0061
9,669,973 B2 * 6/2017 Hoshino ..... B65D 83/0055
9,676,525 B2 * 6/2017 Greiner-Perth .... B65D 47/2068
9,889,966 B2 * 2/2018 Medeiros ..... B65D 47/2018
10,071,836 B2 * 9/2018 Holroyd ..... B65D 47/2018
2002/0130139 A1 * 9/2002 Shiraishi ..... B65D 23/02 222/105
2003/0094467 A1 * 5/2003 Dark ..... B65D 47/2081 222/484
2004/0007601 A1 * 1/2004 Masuda ..... B65D 47/2075 222/494
2004/0112920 A1 * 6/2004 Felten ..... B65D 47/2075 222/212
2006/0054635 A1 * 3/2006 Iwahashi ..... A61F 9/0008 222/107
2006/0197042 A1 * 9/2006 Kneer ..... B65D 47/205 251/82
2007/0045356 A1 * 3/2007 Foster ..... B65D 47/2068 222/494
2007/0051755 A1 * 3/2007 Foster ..... B65D 47/2018 222/494
2014/0144938 A1 * 5/2014 Kakuta ..... B65D 35/14 222/105
2014/0183154 A1 * 7/2014 Essebaggers ..... B65D 47/32 215/311
2014/0263443 A1 * 9/2014 Furusawa ..... B65D 83/0055 222/105
2015/0001260 A1 * 1/2015 Hoshino ..... B65D 47/40 222/481
2015/0216723 A1 * 8/2015 Yoshimura ..... B65D 47/18 604/295
2015/0353245 A1 * 12/2015 Sakimura ..... B65D 47/20 222/545
2016/0311588 A1 * 10/2016 Wochele ..... A61J 1/067
2016/0375452 A1 * 12/2016 Skillin ..... B05B 11/047 222/207
2018/0111724 A1 * 4/2018 Sakimura ..... B65D 41/28
2018/0257831 A1 * 9/2018 Benoit-Gonin ..... B65D 55/024

FOREIGN PATENT DOCUMENTS

JP 63177260 11/1988
JP 0421465 2/1992
JP 200139462 2/2001
JP 2013241197 A2 12/2013
JP 2014-069854 4/2014
JP 3194661 12/2014
WO WO 2013065599 * 5/2013

OTHER PUBLICATIONS

International Search Report dated Jun. 21, 2016 filed in PCT/JP2016/059658.
Chinese Office Action dated Sep. 18, 2018 for the corresponding Chinese Patent Application No. 201680026103.2.
Extended European Search Report dated Nov. 20, 2018 for the corresponding EP patent application No. 16772647.0.

* cited by examiner (a)

(b)

(a)

(b)

CAP

TECHNICAL FIELD

The present invention relates to a cap molded from synthetic resin. More particularly, the present invention relates to a cap which is attached to a container opening portion of a container filled with a liquid content, such as soy sauce, or a flowable content having viscosity, and which is opened and closed by a pressure in the container.

BACKGROUND ART

After the content is used, if the cap is fastened loosely, the sealed state of the interior of the container cannot be maintained, allowing for the entry of air or fungi into the container. As a result, the content becomes oxidized, or molds and the like spread, accelerating the degradation of the content. In order to solve the problem, a cap to be attached to a container opening portion has been proposed. The cap is configured such that, immediately after an appropriate amount of content is used by the user squeezing the body portion of the container to apply an internal pressure to the container, the interior of the container (container opening portion) is sealed without the user operating the cap manually.

For example, Patent Document 1 discloses the following. A cap body fitted on a container opening portion is provided with an ejection passageway communicating with the container opening portion, a base portion, and a check valve. The base portion is fitted in the ejection passageway and includes an ejection hole. The check valve is disposed on the base portion, and only permits the ejection of the content via the ejection hole. The check valve is configured from a cylindrical portion fitted in the ejection passageway, a plurality of elastic pieces that is elastically deformable, and a valve member. The plurality of elastic pieces extends radially from an inner wall surface of the cylindrical portion toward the center, with gaps formed therebetween. The valve member is integrally connected to the distal ends of the elastic pieces, and opens and closes the ejection hole downstream in an ejection direction of the ejection hole. When the internal pressure to the container is removed, the elastic pieces of the check valve recover, whereby the valve member closes the ejection hole to maintain the interior of the container in a sealed state.

CITATION LIST

Patent Literature

Patent Document 1: JP-A-2013-241197

SUMMARY OF INVENTION

Problems to be Solved by the Invention

In the invention disclosed in Patent Document 1, after the content is ejected, as the check valve operates, some of the content that was not ejected via the ejection passageway may fail to return to the interior of the container, and instead remain in the ejection passageway. In this case, when the lid member is closed, the content may be scattered by the cylindrical closing portion of the lid member. Particularly in the case of a liquid content, the scattered liquid content may drip from the top surface portion of the cap body, and become attached to the lower end inner peripheral surface of the lid member. This is not preferable in terms of hygiene, and an improvement has been called for.

The present invention has been made in view of the above. An object of the present invention is to provide a cap with which, after a content is used, the interior of a container is maintained in a sealed state without the user performing a manual operation, and with which, particularly in the case of a liquid content, liquid dripping from a top surface portion of a cap body is suppressed.

Solutions to the Problems

As a means to solve the problem, the invention set forth in claim 1 provides a cap made from synthetic resin and including a cap body to be attached to a container opening portion and a lid member capped on the cap body. The cap body includes an inner plug fitted in an opening portion of a top surface portion, and having an ejection passageway; an annular wall portion having an ejection hole positioned in a radially central portion and communicating with the ejection passageway, and an annular valve seat provided around the ejection hole; and a check valve which is disposed between the annular wall portion and the inner plug and which is configured to open and close the ejection hole as a valve portion is detached from or seated on the annular valve seat. An annular protruding portion is provided on the top surface portion around the inner plug at a radial interval therefrom.

With the invention set forth in claim 1, particularly in the case of a liquid content, even when the liquid content in the ejection passageway of the inner plug is scattered as the lid member is closed; dripping of the liquid from the top surface portion of the cap body can be suppressed by the annular protruding portion.

The invention set forth in claim 2 provides the cap according to claim 1, wherein the annular protruding portion includes an inner surface on the inner plug side which is formed as an inclined surface or a curved surface inwardly from an upper end of the inner surface, the inclined surface being inclined with respect to an axial direction.

With the invention set forth in claim 2, the liquid content remaining inside the annular protruding portion can be easily wiped off.

Effects of the Invention

According to the present invention, a cap is provided with which the interior of the container is maintained in a sealed state without the user performing a manual operation after using the content, and which, particularly in the case of a liquid content, suppresses the dripping of liquid from the top surface portion of the cap body.

DESCRIPTION OF EMBODIMENTS

In the following, a mode of carrying out the present invention will be described with reference to FIG. 1 to FIG. 5.

Figure 1:
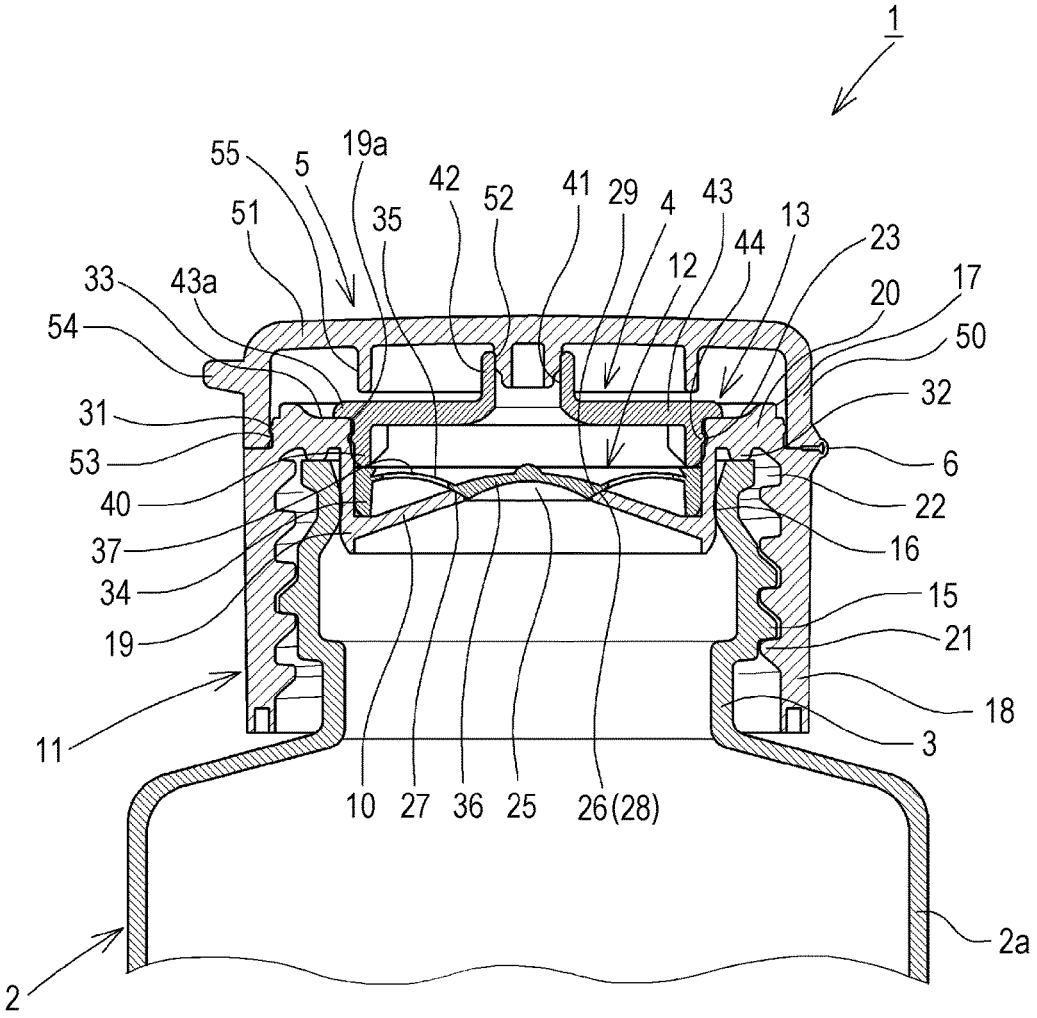
FIG. 1 is a cross sectional view of a cap according to an embodiment of the present invention.
Figure 2:
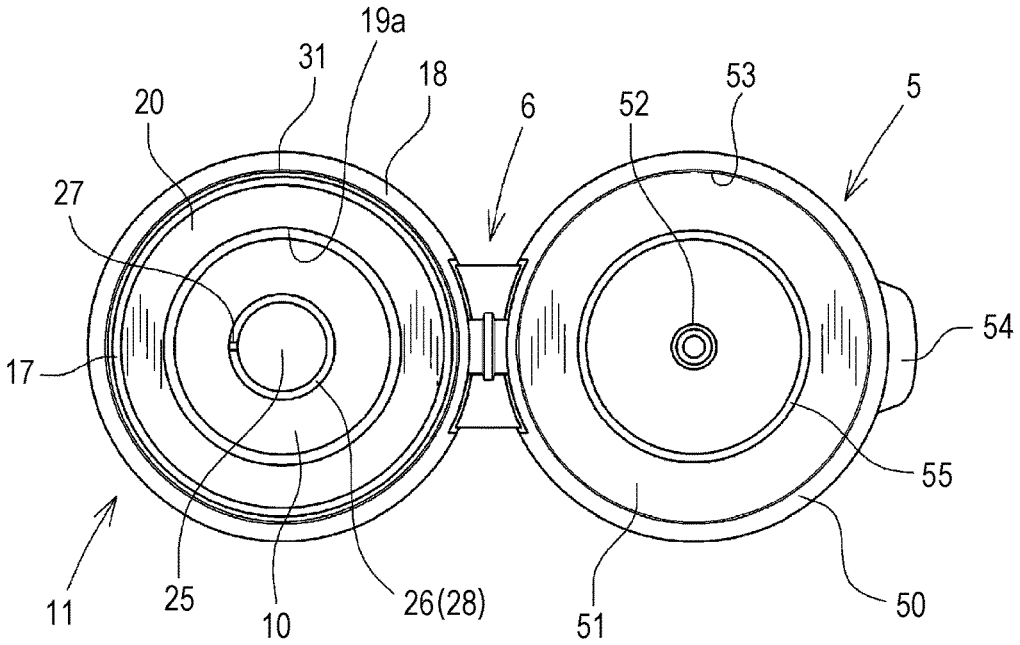
FIG. 2(*a*) is a plan view of a main cap member including a lid member and an annular wall portion in the configuration of the cap of FIG. 1, and FIG. 2(*b*) is a cross sectional view of FIG. 2(*a*).
Figure 2:
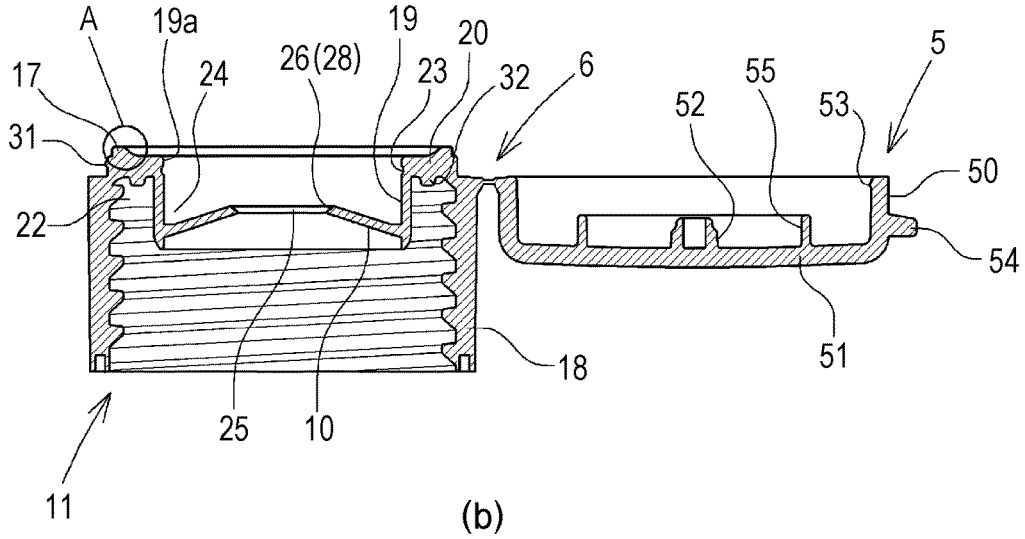

A cap 1 according to an embodiment of the present invention is configured from a cap body 4 and a lid member 5. The cap body 4, as illustrated in FIG. 1, is fitted on a container opening portion 3 of the container 2, and includes an ejection hole 25 for content. The lid member 5 is coupled with a main cap member 11 of the cap body 4 via a hinge 6. The cap 1 is configured by assembling three constituent members of: the main cap member 11 coupled with the lid member 5 and including an annular wall portion 10, as illustrated in FIG. 2; a check valve 12 illustrated in FIG. 4; and an inner plug 13 illustrated in FIG. 5. The lid member 5 may be configured as a separate member, instead of being coupled with the cap body 4 via the hinge 6.

As illustrated in FIG. 1, the container 2 is an easily deformable container, such as a tube container, and is filled inside with a liquid content or a flowable content having viscosity. Examples of the content include soy sauce, olive oil, dressings, mayonnaise, ketchup, ton-katsu (pork cutlet) sauce, and mustard paste. The container 2 is the type of container from which the content is ejected through the application of an internal pressure applied by, for example, squeezing a body portion 2*a* thereof. The container opening portion 3 is formed in a cylindrical shape. On a lower outer wall surface of the container opening portion 3, a male screw portion 15 is formed. On an upper portion of the container opening portion 3, a fitting wall portion 16 is formed, with an entire peripheral wall portion thereof protruding inward. It should be noted that the cap 1 may also be adopted for a double container (including a container referred to as a delamination container) comprising an outer container and an inner container. In this case, the cap 1 would be attached to the outer container opening portion 3 of the inner container 2, with the inner container being internally filled with the content. The inner container would have flexibility and would become shrunk and deformed as the content decreases. In order to maintain the reduced-volume shape of the inner container, the inner container is configured such that outer air can be suctioned between the outer container and the inner container.

The cap body 4 is configured from: the main cap member 11, which is threadedly engaged with the container opening portion 3 and has a cylindrical shape; the annular wall portion 10; the check valve 12; and the inner plug 13. The annular wall portion 10 extends integrally from an inner wall surface of a cylindrical inner wall portion 19 of the main cap member 11, toward the radial center and diagonally upward. The annular wall portion 10 includes an ejection hole 25 in a radially central portion. The check valve 12 is disposed over the annular wall portion 10. The check valve 12 opens and closes the ejection hole 25 by a valve portion 36 being detached from or seated on an annular valve seat 26 around the ejection hole 25. The inner plug 13 is disposed over the check valve 12. The inner plug 13 communicates with the ejection hole 25, and includes an ejection passageway 41 for the content from the ejection hole 25. The check valve 12 is molded from a synthetic resin having higher elasticity than that of a synthetic resin from which the main cap member 11 is molded. Specifically, the main cap member 11 (including the lid member 4) and the inner plug 13 are molded from polyethylene. The check valve 12 is molded from polyethylene or elastomer.

Figure 3:
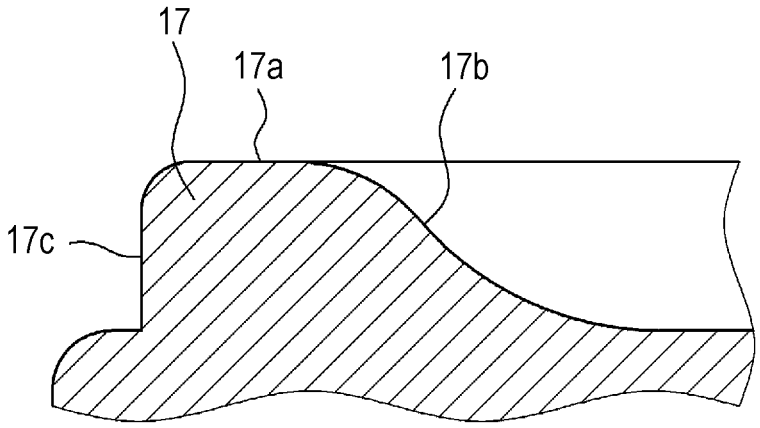
FIG. 3 is an enlarged view of a portion A of FIG. 2(*b*).

As illustrated in FIG. 1 and FIG. 2, the main cap member 11 is configured from: a cylindrical outer wall portion 18 threadedly engaged with the container opening portion 3; the cylindrical inner wall portion 19; and an annular horizontal wall portion 20 as a top surface portion. The cylindrical inner wall portion 19 is disposed concentrically inside the cylindrical outer wall portion 18. The annular horizontal wall portion 20 connects the upper end of the cylindrical outer wall portion 18 and the upper end of the cylindrical inner wall portion 19. On the inner wall surface of the cylindrical outer wall portion 18, a female screw portion 21 is formed in an entire axial area. The female screw portion 21 is threadedly engaged with the male screw portion 15 provided on the container opening portion 3. Between the cylindrical inner wall portion 19 and the cylindrical outer wall portion 18, an annular space 22 is formed. The upper end opening of the cylindrical inner wall portion 19 provides an opening portion 19*a* in which the inner plug 13 is fitted. In an outer peripheral portion on the upper surface of the annular horizontal wall portion 20, an annular protruding portion 17 which protrudes upward is formed. As illustrated in FIG. 3, the annular protruding portion 17 has a cross sectional shape configured from a horizontally extending upper surface 17*a*, a curved inner surface 17*b*, and an outer surface 17*c*. The curved inner surface 17*b* extends radially inward from one end on the inner side of the upper surface 17*a*, forming a smoothly curving recessed shape. The outer surface 17*c* axially extends from the other end on the outer side of the upper surface 17*a*. Alternatively, the inner surface 17*b* may be formed as an inclined surface extending radially inward at an angle with respect to the axial direction. As illustrated in FIG. 2(*b*), in an upper inner wall surface of the cylindrical inner wall portion 19, an annular fitting recess portion 23 is formed extending annularly in a circumferential direction.

As illustrated in FIG. 1 and FIG. 2, the annular wall portion 10 integrally extends from the entire area in the circumferential direction of a lower inner wall surface of the cylindrical inner wall portion 19, toward the radial center and diagonally upward. The annular wall portion 10 has a truncated cone shape. The annular wall portion 10 and the inner wall surface of the cylindrical inner wall portion 19 form an upwardly open space 24. In the radially center portion of the annular wall portion 10, there is the ejection hole 25, which has a substantially circular shape. The ejection opening 25 communicates with the interior of the container opening portion 3. Around the ejection hole 25, the annular valve seat 26 is formed. The annular valve seat 26 is formed on an inverted cone shaped surface 28. At one location in the annular valve seat 26 (inverted cone shaped surface 28) of the annular wall portion 10, a circulation groove 27 is formed in the radial direction. The circulation groove 27 is formed on the opposite side from the side of the hinge 6. The circulation groove 27 is formed with a substantially U-shaped cross section.

The annular horizontal wall portion 20 has an outer diameter which is smaller than an outer diameter of the cylindrical outer wall portion 18. On the outer wall surface of the annular horizontal wall portion 20, a ridged locking portion 31 is formed extending annularly in the circumferential direction. On the outer wall surface of the annular horizontal wall portion 20, the lid member 5 is fitted. On the lower surface of the annular horizontal wall portion 20 between the cylindrical outer wall portion 18 and the cylindrical inner wall portion 19, an annular seal portion 32 descends concentrically. The lower end of the annular seal portion 32 is closely contacted with the upper end of the container opening portion 3.

Figure 4:
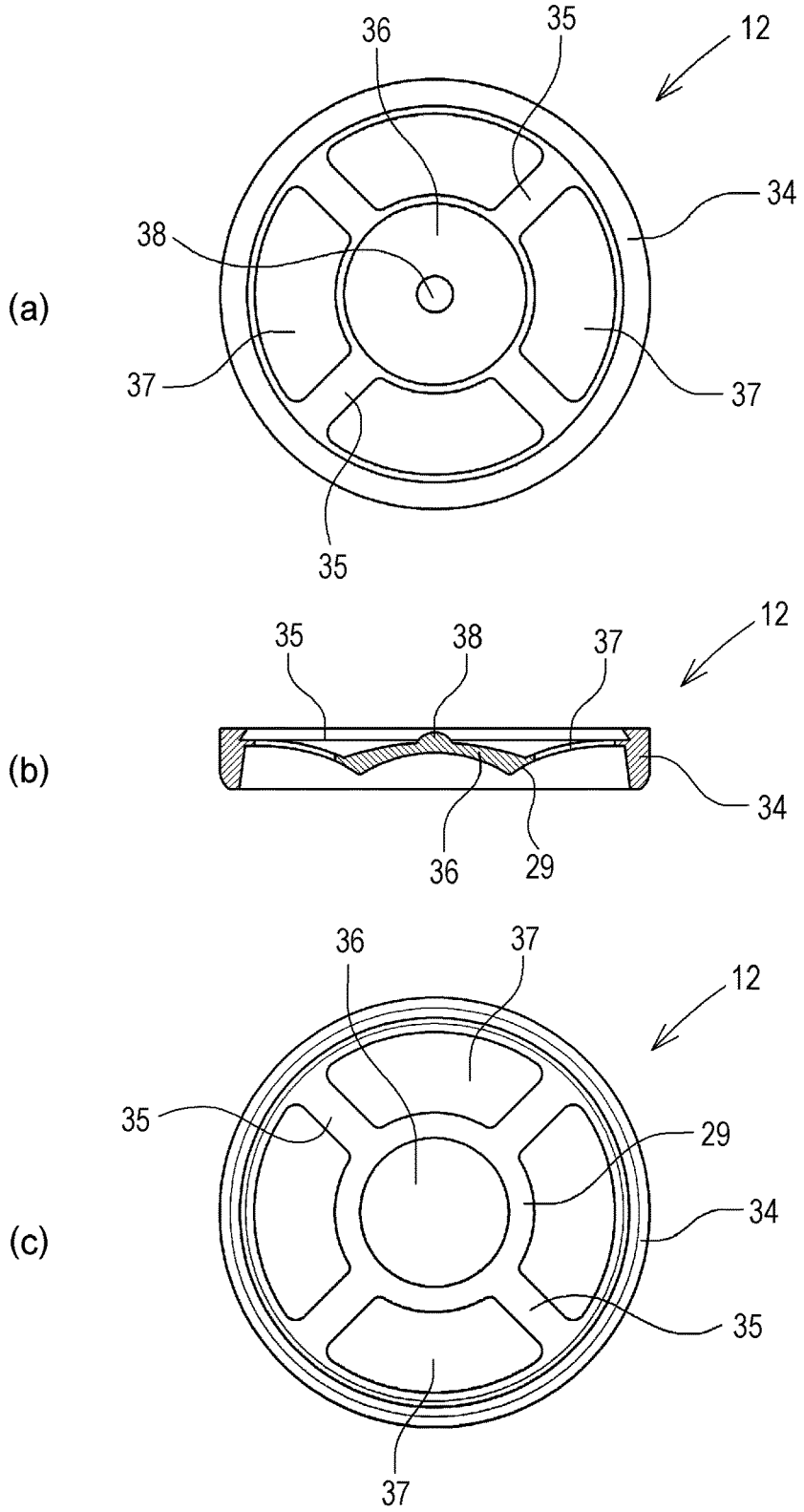
FIG. 4(*a*) is a plan view of a check valve in the configuration of the cap of FIG. 1, FIG. 4(*b*) is a cross sectional view of FIG. 4(*a*), and FIG. 4(*c*) is a bottom view.

As illustrated in FIG. 1 and FIG. 4, the check valve 12 is configured from a cylindrical support portion 34, a plurality of elastic pieces 35, the valve portion 36, and a plurality of circulation holes 37. The cylindrical support portion 34 abuts on the inner wall surface of the cylindrical inner wall portion 19 of the main cap member 11. The plurality of elastic pieces 35 extends integrally from the inner wall surface of the cylindrical support portion 34 toward radial center. The valve portion 36 is integrally connected to the distal end portion of each of the elastic pieces 35, and opens and closes the ejection hole 25. The plurality of circulation holes 37 is provided between the respective elastic pieces 35. Through the circulation holes 37, the content from the ejection hole 25 is circulated.

The elastic pieces 35 extend from the upper inner wall surface of the cylindrical support portion 34 toward the radial center and diagonally downward, while slightly curving. In the present embodiment, the elastic pieces 35 are formed at four locations at a 90° pitch in the circumferential direction. Between the elastic pieces 35, the circulation holes 37 are formed at four locations at a 90° pitch. The distal end portion of each of the elastic pieces 35 is integrally connected to the upper edge of the outer peripheral portion of the valve portion 36. The valve portion 36 has a dome shape. Specifically, the valve portion 36 has a circular shape as viewed in plan, and includes an upwardly protruding curved wall portion. The outer peripheral portion of the valve portion 36 is formed with an inverted cone shaped surface 29 so as to be seated on the annular valve seat 26 (inverted cone shaped surface 28). From the upper surface of the valve portion 36, a spherical protruding portion 38 rises.

Figure 5:
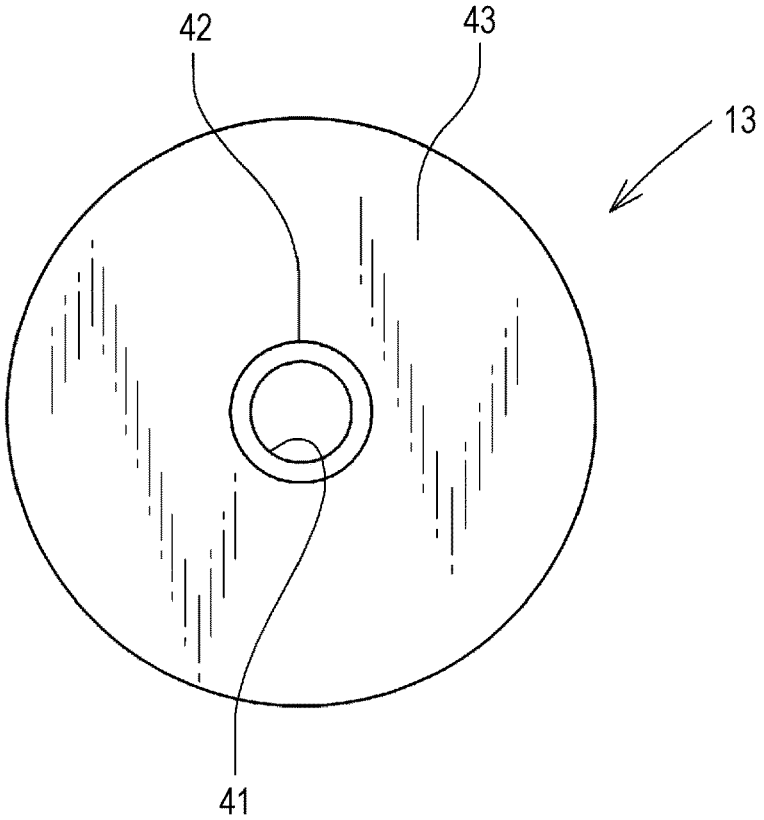
FIG. 5(*a*) is a plan view of an inner plug in the configuration of the cap of FIG. 1, and FIG. 5(*b*) is a cross sectional view of FIG. 4(*a*).
Figure 5:
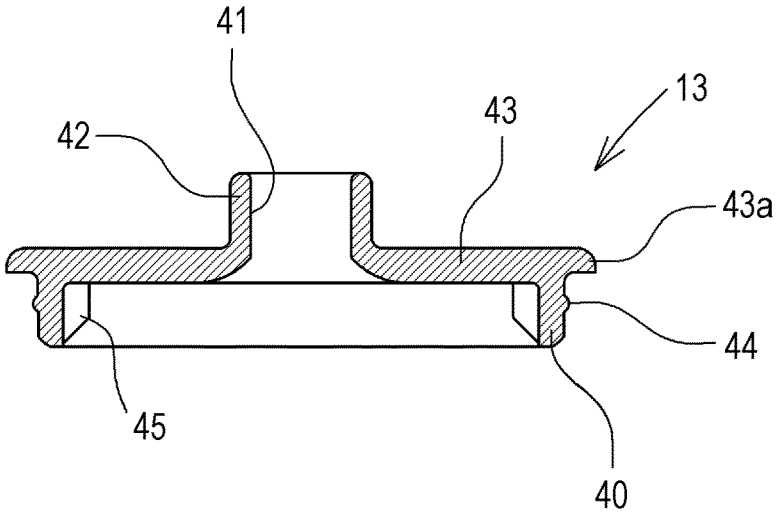

As illustrated in FIG. 1 and FIG. 5, the inner plug 13 is disposed over the check valve 12. The inner plug 13 is configured from a cylindrical support portion 40, a cylindrical guide portion 42, and an annular horizontal wall portion 43. The cylindrical support portion 40 is fitted on the cylindrical inner wall portion 19 of the main cap member 11. The cylindrical guide portion 42 is concentrically disposed inside the cylindrical support portion 40, and includes the ejection passageway 41 therein. The annular horizontal wall portion 43 integrally connects the upper end of the cylindrical support portion 40 and the lower end of the cylindrical guide portion 42. The annular horizontal wall portion 43 is formed with an annular flange portion 43*a* radially protruding from the outer peripheral surface of the cylindrical support portion 40. Between the lower wall surface of the annular horizontal wall portion 43 and the inner wall surface of the cylindrical support portion 40, a plurality of reinforcement ribs 45 is formed at intervals in the circumferential direction. The annular flange portion 43*a* is formed so as to be slightly higher than the annular protruding portion 17 provided on the upper surface of the outer peripheral portion of the annular horizontal wall portion 20 of the main cap member 11. The upper surface from the annular horizontal wall portion 43 to the annular flange portion 43*a* extends horizontally. The upper surface from the annular horizontal wall portion 43 to the annular flange portion 43*a* may be formed as an inclined surface that is gradually downwardly inclined radially outward. Alternatively, the annular flange portion 43*a* may be omitted, and the upper surface of the annular horizontal wall portion 43 and the upper surface (the bottom surface of an annular accumulating groove portion 33 which will be described later) of the annular horizontal wall portion 20 of the main cap member 11 may be made flush. The cylindrical support portion 40 is disposed over the cylindrical support portion 34 of the check valve 12. On the outer wall surface of the cylindrical support portion 40, an annular ridge portion 44 is formed extending in the circumferential direction. The peripheral wall portion of the cylindrical support portion 40 has a thickness which is substantially the same as the thickness of the peripheral wall portion of the cylindrical support portion 34 of the check valve 12.

As illustrated in FIG. 1 and FIG. 2, the lid member 5 is integrally connected to the cylindrical outer wall portion 18 of the main cap member 11 via the hinge 6. The lid member 5 is configured from a cylindrical body portion 50 and a top surface portion 51. The cylindrical body portion 50 is connected to the outer wall surface of the cylindrical outer wall portion 18 of the main cap member 11 via the hinge 6. The top surface portion 51 is integrally connected to the entire areas in the circumferential direction of the upper end of the body portion 50. From the radially central portion of the top surface portion 51, a cylindrical close contact portion 52 descends. The cylindrical close contact portion 52 is closely fitted in the upper end of the cylindrical guide portion 42 of the inner plug 13 of the cap body 4. Between the body portion 50 and the cylindrical close contact portion 52 of the top surface portion 51, a cylindrical scattering suppression portion 55 descends. On the lower inner wall surface of the body portion 50, formed is a ridged locking portion 53 annularly extending in the circumferential direction. On the upper outer wall surface of the body portion 50 on the opposite side from the hinge 6, a holding portion 54 to be held by the user protrudes outward in a predetermined range in the circumferential direction.

A method for assembling the cap 1 and attaching the cap 1 to the container opening portion 3 will be described.

First, the check valve 12 is installed on the upper surface of the annular wall portion 10 of the main cap member 11 from above. Specifically, the check valve 12 is disposed on the upper surface of the annular wall portion 10 in such a way that the outer wall surface of the cylindrical support portion 34 of the check valve 12 lies along the inner wall surface of the cylindrical inner wall portion 19 of the main cap member 11. That is, the check valve 12 is installed from above into the space 24 with an open top enclosed by the annular wall portion 10 and the inner wall surface of the cylindrical inner wall portion 19.

Then, the inner plug 13 is disposed in the opening portion 19*a* of the cylindrical inner wall portion 19 of the main cap member 11. That is, the inner plug 13 is disposed in such a way that the outer wall surface of the cylindrical support portion 40 of the inner plug 13 lies along the inner wall surface of the cylindrical inner wall portion 19 of the main cap member 11. The inner plug 13 is installed so as to push in the check valve 12. In this way, the annular ridge portion 44 provided on the outer wall surface of the cylindrical support portion 40 of the inner plug 13 is fitted in the annular fitting recess portion 23 provided on the inner wall surface of the cylindrical inner wall portion 19 of the main cap member 11. Also, the annular flange portion 43*a* of the inner plug 13 abuts on the upper surface of the annular horizontal wall portion 20. In this way, the inner plug 13 is installed. As a result, the outer peripheral portion of the valve portion 36 (inverted cone shaped surface 29) of the check valve 12 becomes closely attached to the annular valve seat 26 (inverted cone shaped surface 28) around the ejection hole 25 of the annular wall portion 10. In this case, the lower end (outer peripheral portion) of the valve portion 36 of the check valve 12 is positioned higher than its position before installation. Accordingly, due to a downward urging force (recovery force) of the elastic pieces 35 that are curved, the outer peripheral portion of the valve portion 36 (inverted cone shaped surface 29) of the check valve 12 becomes closely contacted with the annular valve seat 26 (inverted cone shaped surface 28) around the ejection hole 25 of the annular wall portion 10 so as to press the annular valve seat 26. The cylindrical guide portion 42 of the inner plug 13 is positioned immediately over the valve portion 36 of the check valve 12 (ejection hole 25). At an interval from the outer peripheral surface of the annular flange portion 43*a* of the inner plug 13 in the radial direction, the annular protruding portion 17 provided on the annular horizontal wall portion 20 of the main cap member 11 is positioned. In this way, between the annular flange portion 43*a* of the inner plug 13 and the annular protruding portion 17 of the main cap member 11, the annular accumulating groove portion 33 is formed. Thus, the assembly of the cap body 4 is completed.

When the lid member 5 is capped on the cap body 4, the hinge 6 is bent and the lid member 5 is disposed so as to cover the cap body 4 from above. Then, the ridged locking portion 53 provided on the body portion 50 of the lid member 5 becomes engaged across the ridged locking portion 31 provided on the annular horizontal wall portion 20 of the main cap member 11. Also, the cylindrical close contact portion 52 provided on the top surface portion 51 of the lid member 5 is closely fitted in the upper end of the cylindrical guide portion 42 of the inner plug 13 of the cap body 4. The cylindrical scattering suppression portion 55 provided on the lid member 5 is disposed on the upwardly extended line of the cylindrical support portion 40 of the inner plug 13. The lower end of the cylindrical scattering suppression portion 55 is disposed in proximity to the upper surface of the annular horizontal wall portion 43.

When the cap body 4 is attached to the container opening portion 3, the peripheral wall portion of the container opening portion 3 is inserted into the annular space 22 between the cylindrical inner wall portion 19 and the cylindrical outer wall portion 18 of the cap body 4. Further, the male screw portion 15 provided on the outer wall surface of the container opening portion 3 and the female screw portion 21 provided on the inner wall surface of the cylindrical outer wall portion 18 of the cap body 4 are threadedly engaged with each other. As a result, the outer wall surface of the cylindrical inner wall portion 19 of the main cap member 11 is press-contacted by the fitting wall portion 16 of the container opening portion 3. The lower end of the annular seal portion 32 descending from the lower surface of the annular horizontal wall portion 20 of the main cap member 11 is closely contacted with the upper end of the container opening portion 3. In this way, the attachment of the cap 1 to the container opening portion 3 is completed. While in the present embodiment the method for attaching the cap 1 to the container opening portion 3 by threaded engagement has been described, the cap may be attached by other attaching methods, such as by capping.

The operation of the cap 1 according to the embodiment of the present invention will be described.

When the content is used, first the lid member 5 is opened to externally expose the inner plug 13 of the cap body 4.

Then, the container 2 is inclined and placed in an ejecting state where the ejection passageway 41 of the inner plug 13 faces downward, and the body portion 2*a* of the container 2 is squeezed to apply internal pressure to the container 2. In this way, the internal pressure of the container 2 acts on the entire area of the lower wall surface of the valve portion 36 of the check valve 12. As a result, the elastic pieces 35 of the check valve 12 are elastically deformed and bent, whereby the outer peripheral portion (inverted cone shaped surface 29) of the valve portion 36 is detached from the annular valve seat 26 (inverted cone shaped surface 28) around the ejection hole 25 of the annular wall portion 10. Consequently, the ejection hole 25 of the annular wall portion 10 is opened, and an appropriate amount of the content is ejected outwardly from within the container opening portion 3, via the ejection hole 25, the circulation holes 37 of the check valve 12, and the ejection passageway 41 of the inner plug 13.

Thereafter, when the squeezing of the body portion 2*a* of the container 2 is stopped, the internal pressure to the container 2 is released, and the elastic pieces 35 of the check valve 12 recover. The outer peripheral portion (inverted cone shaped surface 29) of the valve portion 36 is seated on the annular valve seat 26 (inverted cone shaped surface 28) around the ejection hole 25 of the annular wall portion 10, and the ejection hole 25 of the annular wall portion 10 is closed by the valve portion 36. In this case, the content that was not ejected outwardly from the ejection passageway 41 of the inner plug 13 returns back into the container 2 via the circulation groove 27. Thereafter, the pressing force from the valve portion 26 to the annular valve seat 26 increases. Because the valve portion 36 has elasticity, the opening area of the circulation groove 27 decreases. Finally, the content blocks the opening of the circulation groove 27 by surface tension, the opening being very small. Accordingly, the interior of the container 2 can be maintained in a hermetically sealed state. Thus, while the content in the cap body 4 that was not ejected is returned into the container 2, the interior of the container 2 can be quickly hermetically sealed immediately after use, without the user manually operating the cap 1, and the entry of air into the interior of the container 2 can be suppressed.

Next, the hinge 6 is bent and the lid member 5 is moved to cover the cap body 4 from above. In this way, the ridged locking portion 53 provided on the body portion 50 of the lid member 5 becomes engaged so as to move across the ridged locking portion 31 provided on the annular horizontal wall portion 20 of the cap body 4 (main cap member 11). Also, the cylindrical close contact portion 52 provided on the top surface portion 51 of the lid member 5 is closely fitted in the upper end of the cylindrical guide portion 42 of the inner plug 13 of the cap body 4.

If, particularly in the case of a liquid content, some of the liquid content that has not been ejected and remains in the ejection passageway 41 (cylindrical guide portion 42) of the inner plug 13, due to the fitting of the cylindrical close contact portion 52 of the lid member 5 in the cylindrical guide portion 42 of the inner plug 13, the liquid content is scattered from within the cylindrical guide portion 42 and reaches the annular horizontal wall portion 43 of the inner plug 13, while interfering with the top surface portion 51 and the cylindrical scattering suppression portion 55 of the lid member 5. The liquid content, however, is blocked by the annular protruding portion 17 provided on the annular horizontal wall portion 20 of the main cap member 11, and is prevented from further flowing outward. The liquid content is accumulated in the annular accumulating groove portion 33 between the annular flange portion 43*a* of the inner plug 13 and the annular protruding portion 17. Accordingly, hardly any of the scattered liquid content flows downward along the outer wall surface of the annular horizontal wall portion 20 of the main cap member 11. Thus, the attachment of the liquid content onto the lower end inner peripheral surface of the body portion 50 of the lid member 5 can be suppressed. When the lid member 5 is capped on the cap body 4, the entry of foreign matter into the cap body 4 (between the inner plug 13 and the check valve 12 and annular wall portion 10) is suppressed, and the interior of the container 2 is doubly sealed. In addition, because the interior of the cap body 4 is sealed by the lid member 5, the small amount of content that may remain in the space 24 over the annular wall portion 10 does not become oxidized.

As described above, in the cap 1 according to the embodiment of the present invention, the annular protruding portion 17 is provided on the annular horizontal wall portion 20 (top surface portion) of the cap body 4 (main cap member 11) around the inner plug 13 at a radial interval. Between the annular flange portion 43*a* of the inner plug 13 and the annular protruding portion 17, the annular accumulating groove portion 33 is provided. Particularly in the case of a liquid content, if some of the liquid content remains in the cylindrical guide portion 42 of the inner plug 13, the liquid content is scattered from within the cylindrical guide portion 42 when the lid member 5 is placed after use. The liquid content reaches the annular horizontal wall portion 43 of the inner plug 13 after interfering with the top surface portion 51 and the cylindrical scattering suppression portion 55 of the lid member 5. The liquid content, however, is blocked by the annular protruding portion 17 provided on the annular horizontal wall portion 20 of the main cap member 11, and is prevented from further flowing outward. The liquid content is accumulated in the annular accumulating groove portion 33 between the annular flange portion 43*a* of the inner plug 13 and the annular protruding portion 17. Thus, the scattered liquid content does not flow downward along the outer wall surface of the annular horizontal wall portion 20 of the main cap member 11. As a result, the attachment of the liquid content onto the lower end inner peripheral surface of the body portion 50 of the lid member 5 can be suppressed, and the need for hygiene is also satisfied.

In addition, in the cap 1 according to the embodiment of the present invention, the inner surface of the annular protruding portion 17 is formed as a curved surface curving in a recessed shape. Accordingly, the user easily wipes off the liquid content in the annular accumulating groove portion 33.

Furthermore, in the cap 1 according to the embodiment of the present invention, the annular protruding portion 17 is provided on the annular horizontal wall portion 20 of the cap body 4 (main cap member 11) around the inner plug 13 at a radial interval. Accordingly, in addition to the above-mentioned operation/effects, a malicious attempt to remove the inner plug 13 by inserting a sharp tool and the like between the annular flange portion 43*a* of the inner plug 13 and the annular horizontal wall portion 20 of the main cap member 11 can be prevented. That is, the annular protruding portion 17 makes it difficult to insert a sharp tool and the like between the annular flange portion 43*a* of the inner plug 13 and the annular horizontal wall portion 20 of the main cap member 11.

DESCRIPTION OF REFERENCE SIGNS

1 Cap
2 Container
3 Container opening portion
4 Cap body
5 Lid member
6 Hinge
10 Annular wall portion
12 Check valve
13 Inner plug
17 Annular protruding portion
17*b* Inner surface
19*a* Opening portion
20 Annular horizontal wall portion (top surface portion)
25 Ejection hole
26 Annular valve seat
33 Annular accumulating groove portion
36 Valve portion
41 Ejection passageway
50 Lid member

The invention claimed is:

1. A cap made from synthetic resin and comprising a cap body to be attached to a container opening portion and a lid member capped on the cap body, the cap body including:

a longitudinal center axis;

an inner plug fitted in an opening portion of a top surface portion and having an ejection passageway;

an annular wall portion haying an ejection hole positioned in a radially central portion of the annular wall portion and communicating with the ejection passageway, and an annular valve seat provided around the ejection hole; and a check valve which is disposed between the annular wall portion and the inner plug and which is configured to open and close the ejection hole as a valve portion is detached from or seated on the annular valve seat, wherein an annular protruding portion is provided on the top surface portion around the inner plug at a radial interval therefrom the inner plug comprises:

a cylindrical support portion fitted in the opening portion;

a cylindrical guide portion including the ejection passageway therein; and an annular horizontal wall portion which integrally connects the cylindrical support portion and the cylindrical guide portion, the annular horizontal wall portion comprises an annular flange portion protruding from an outer peripheral surface of the cylindrical support portion, and the cap body further includes an annular accumulating groove portion between the annular flange portion and the annular protruding portion.

2. The cap according to claim 1, wherein the annular protruding portion includes an inner surface on an inner plug side, the inner surface being formed as an inclined surface or a curved surface inwardly from an upper end of the inner surface, the inclined surface being inclined with respect to direction of the longitudinal center axis.

* * * * *